US009474987B1

(12) United States Patent
Lund et al.

(10) Patent No.: US 9,474,987 B1
(45) Date of Patent: Oct. 25, 2016

(54) MULTIPLE SONIC MOTION DEVICES

(71) Applicant: Lund and Company Invention, LLC, River Forest, IL (US)

(72) Inventors: Bruce D. Lund, River Forest, IL (US); Michael D. Starrick, Maywood, IL (US); Guruge Weerauppulige, Forest Park, IL (US)

(73) Assignee: LUND AND COMPANY INVENTION, LLC, River Forest, IL (US)

( * ) Notice: Subject to any disclaimer, the term of this patent is extended or adjusted under 35 U.S.C. 154(b) by 479 days.

(21) Appl. No.: 13/945,624

(22) Filed: Jul. 18, 2013

Related U.S. Application Data

(63) Continuation-in-part of application No. 12/497,794, filed on Jul. 6, 2009, now Pat. No. 8,498,433, and a continuation-in-part of application No. 12/985,846, filed on Jan. 6, 2011, now Pat. No. 8,755,540.

(51) Int. Cl.
*H04R 25/00* (2006.01)
*A63H 33/04* (2006.01)
*H04R 1/02* (2006.01)

(52) U.S. Cl.
CPC ..... *A63H 33/04* (2013.01); *H04R 1/028* (2013.01)

(58) Field of Classification Search
USPC ..... 381/71.2, 162, 164, 178, 191; 310/81, 310/328, 323.01, 330, 323.17, 323.03, 310/323.06, 322; 181/141, 143, 161–163; 185/38, 39; 446/3, 65; 463/65, 69; 367/180
See application file for complete search history.

(56) References Cited

U.S. PATENT DOCUMENTS

| | | | | |
|---|---|---|---|---|
| 853,730 | A | 5/1907 | Pearson | |
| 2,392,547 | A | 1/1946 | Piebanek | |
| 2,400,261 | A | 5/1946 | Piebanek | |
| 2,811,809 | A | 11/1957 | Di Franco | |
| 3,196,580 | A | 7/1965 | Rakestraw | |
| 4,882,500 | A | 11/1989 | Iijima | |
| 5,679,047 | A | 10/1997 | Engel | |
| 6,404,104 | B1 * | 6/2002 | Maeno et al. | 310/323.02 |
| 7,317,275 | B2 | 1/2008 | Treat | |
| 7,436,101 | B1 | 10/2008 | Magnussen | |
| 7,927,170 | B2 | 4/2011 | Bickerton | |
| 8,378,196 | B2 | 2/2013 | Lund | |
| 8,498,433 | B1 | 7/2013 | Lund | |
| 8,755,540 | B1 | 6/2014 | Lunc | |
| 8,911,275 | B2 | 12/2014 | Maddocks | |
| 2005/0199472 | A1 * | 9/2005 | Kato et al. | 198/750.8 |
| 2006/0125336 | A1 * | 6/2006 | Treat | 310/81 |
| 2006/0252340 | A1 | 11/2006 | Bach | |
| 2009/0311941 | A1 * | 12/2009 | Bickerton et al. | 446/3 |
| 2009/0320978 | A1 | 12/2009 | Martinez | |
| 2011/0111671 | A1 * | 5/2011 | Norman et al. | 446/268 |
| 2013/0084773 | A1 * | 4/2013 | Mimlitch et al. | 446/391 |

* cited by examiner

*Primary Examiner* — Paul S Kim
(74) *Attorney, Agent, or Firm* — Invention Mine LLC

(57) ABSTRACT

The subject application is directed to various sonic motion devices including a number of play sets in which a number of components located on a vibrating surface are moved in multiple directions as determined by the orientation of vibration fibers secured thereto and responsive to the vibrating surface. Also included an action figure having various features moved by sonic motion which may be correlated with sound such a movable jaw and a synchronized sound.

13 Claims, 13 Drawing Sheets

MULTIPLE SONIC MOTION DEVICES

CROSS REFERENCE TO RELATED APPLICATIONS

This present application is a continuation-in-part application of application Ser. No. 12/497,794 entitled Sonic Motion Apparatus filed Jul. 6, 2009 and application Ser. No. 12/985,846 entitled Sonic Motion Operated. Devices filed Jan. 6, 2011.

FIELD OF THE INVENTION

The present invention relates to various toy devices that are operated by sonic motion such as toy figures, ornaments, battling figures, dispensers and a wide variety of games etc. The operation of the various devices will be controlled by a signal generator such as a microprocessor that will vary the speed and movement of the various objects that are in positions to respond to the sonic vibration.

BACKGROUND OF THE INVENTION

The use of sonic vibration to activate motions of various toys is set forth in the earlier filed applications set forth above. However its use has been expanded to a wider variety of devices that have not hereto for taken advantage of the sonic vibration phenomena. It has long been desired to use sonic motion for a wide variety of mechanism such as toy battleships, prize fighters, flying aircraft, and game sets and other toys that have heretofore required motors to operate.

DESCRIPTION OF THE INVENTION

The present invention relates to devices that utilizes sonic motion directly or indirectly. They are controlled by a microprocessor that can be programmed to generate sounds through a speaker or other vibrating source having a varying or steady frequency or amplitude to vary the speed and/or movement of an object placed in direct or indirect contact with a speaker, diaphragm or the like that is energized by sound waves. This can be accomplished by placing an object on a vibration generating member such as a speaker diaphragm surface that directly moves the object placed thereon or by transferring the sound waves through intermediate members to obtain a desired motion. Through the use of directional members located on the bottom of the object being moved or on a member or members interconnected to the object being moved by direct or indirect contact with the vibration generating member such as a speaker diaphragm the object will respond to the sound waves to move in a rotary and/or linear direction.

A programmed microprocessor is but one way that the sonic motion can be accommodated. The particular movement of the object in question can, in one instance be controlled by directional members located on the bottom of the object being moved and subjected to the vibrations imparted against the directional members or conversely the directional members can be located on the vibration imparting element to act upon the object in question.

DESCRIPTION OF THE DRAWINGS

FIG. 1(*b*) is a front view of the action figure of FIG. 1(*a*) showing the movement of the mechanism to accomplish the jaw movement;

FIG. 1(*c*) is a cross sectional view of a vehicle having a front member movable in response to a sonically operated member;

FIG. 1(*d*) is a cross sectional view of a plush member similar to the action figure of FIG. 1(*a*) having a movable jaw;

FIG. 3(*b*) illustrates a construction figure mounted on a rotating base operated by a vibration source that is controlled by a signal generator;

FIG. 3(*c*) discloses a toy gun turret that is controlled by vibrator reaction members reacting to a sonic motion device;

FIG. 3(*d*) shows a swinging gun turret that is swung from side to side by a cranking mechanism operated by sonically activated members;

FIG. 3(*e*) discloses an elevated observation platform having a signal disk and play flag activated by a vibration source through an upright vibration transfer column;

FIG. 3(*f*) is a three quarter perspective view of a building block play set including a vibration activated galling gun, oriented sled base, gun turret, swinging gun turret, drive disk, signal disk and play flag;

FIG. 4(*b*) is a cross sectional view of the plumbing game of FIG. 4(*a*);

FIG. 7(*b*) is a perspective view of the winged toy character of FIG. 7(*a*);

DESCRIPTION OF THE DRAWINGS

Figure 1A:
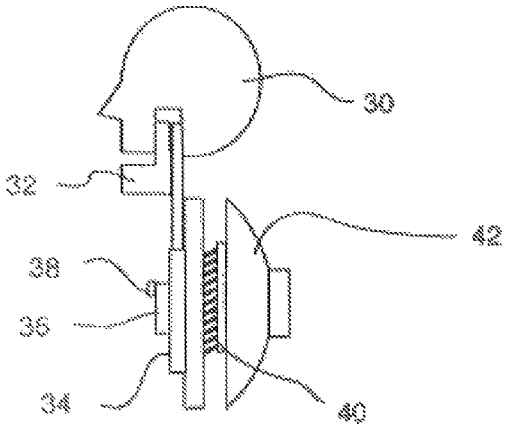
FIG. 1(*a*) is a side view of an action figure having a movable jaw operated by a sonically operated mechanism.
Figure 1B:
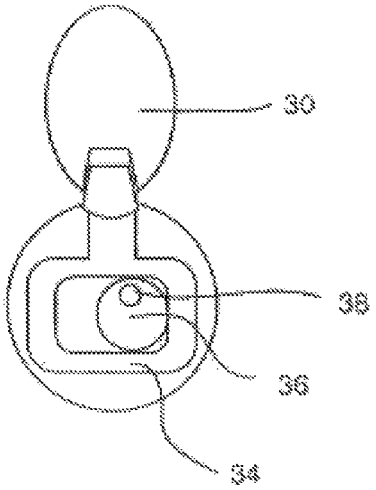
Figure 1C:
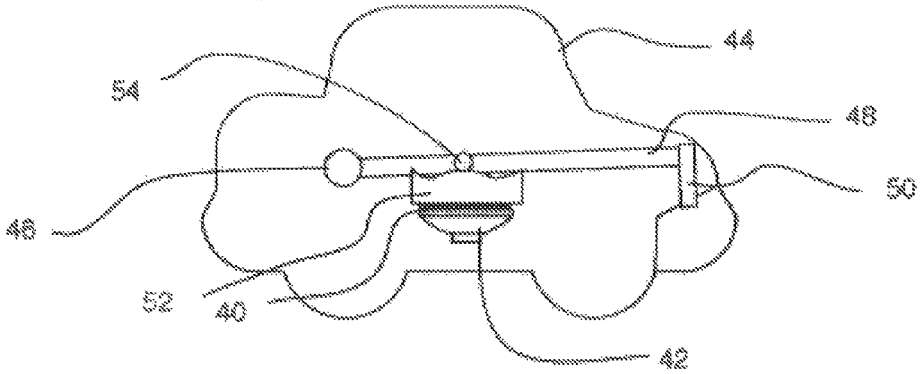
Figure 1D:
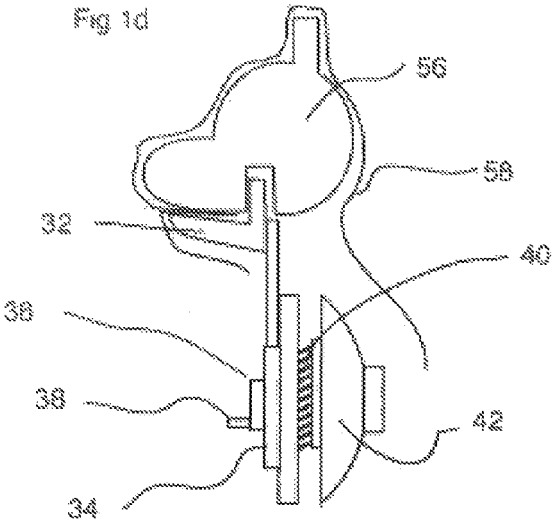

In FIG. 1(*a*) we see a side view of an action figure 30 with a movable lower jaw 32. Movable lower jaw 32 is moved from an open to a closed position by cam follower 34. Cam follower 34 is moved by eccentric rotary cam 36 which has vibration reaction members 40. Eccentric rotary cam 36 rotates around cam center pivot 38. Vibration reaction members are excited by vibration source 42. It should be further noted that vibration source 42 is controlled by a signal generator (not illustrated) that supplies inputs that impart differing frequencies and amplitude to be expressed by the vibration source 42. These inputs can be timed to synchronize the movable lower jaw 32 actions to simulate speech.

FIG. 1(*b*) is front view of action figure 30 showing the relationship between cam follower 34, eccentric rotary cam 36 and cam center pivot 38.

In FIG. 1(*c*) we see a cross sectional view of a vehicle 44 that has a vibration sound source 42 controlled by a signal generator interacting with vibration reaction members 40 which in turn are driving rotary face cam 52. Rotary face cam 52 lifts pin 54 which is connected to bar 48 which in turn moves lip teeth plate 50. Bar 48 has pivot 46 to guide and limit any lateral movement. In this embodiment rotary cam plate 52 controls the lip teeth plate 50. A secondary mechanism could also be provided to move reflectors or the like from the rotary face cam 52. Vibration reaction members 40 are excited by vibration source 42. It should be further noted that vibration source 42 is controlled by a signal generator (not shown), that supplies inputs that impart differing frequencies and amplitude to be expressed by the vibration source 42. These inputs can be timed to synchronize the lip teeth plate 50 action to simulate speech.

In FIG. 1(*d*) we see a cross sectional view of a plush character 56 with a movable lower jaw 32. Movable lower jaw 32 is moved from an open to a closed position by cam follower 34. Cam follower 34 is moved by eccentric rotary cam 36 which has vibration reaction members 40. Eccentric rotary cam 36 rotates around cam center pivot 38. Vibration reaction members 40 are excited by vibration source 42. Plush character 56 has a plush covering 58 that encloses the mechanism and covers any objectionable hard plastic structure. Here again the vibration source 42 is controlled by a signal generator (not shown) that supplies inputs of different frequencies and amplitude that may be timed to synchronize the movable lower jaw 32 to simulate speech.

Figure 2:
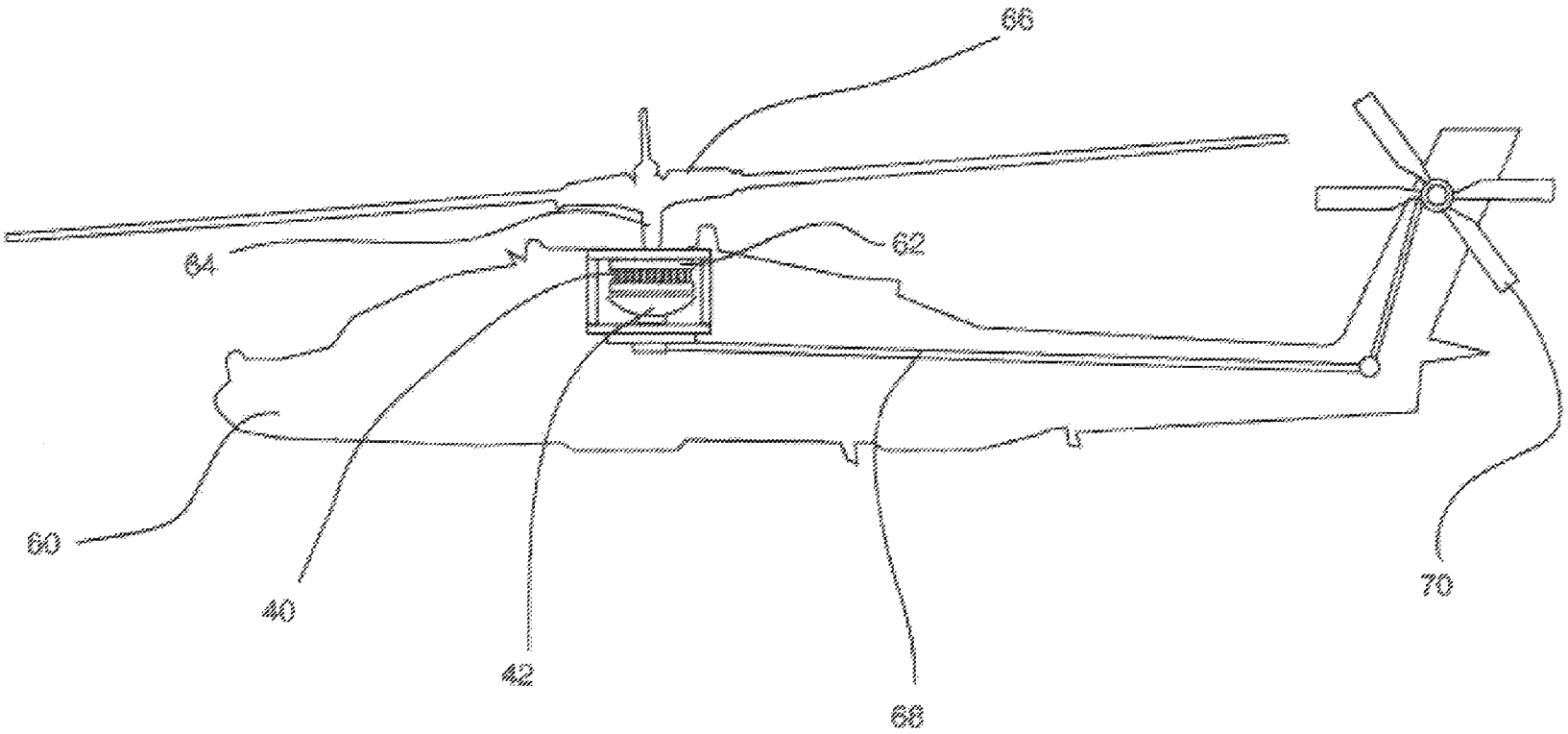
FIG. 2 illustrates a cross-sectional view of a toy helicopter in which the rotor blades are operated by a sonic motion assemblage.
Figure 3A:
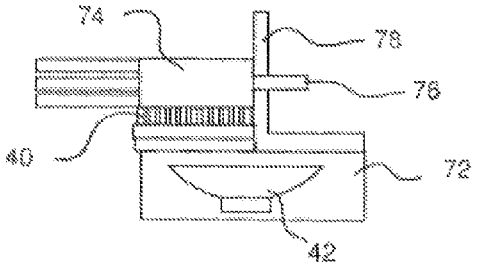
FIG. 3(*a*) is a cross sectional view of a building block including a vibration source for operating a toy gatling gun disposed thereon.
Figure 3B:
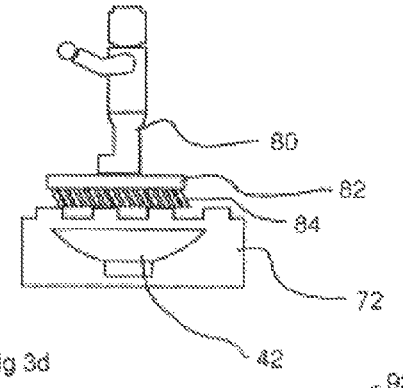
Figure 3C:
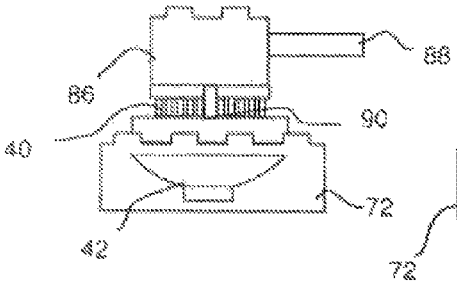
Figure 3D:
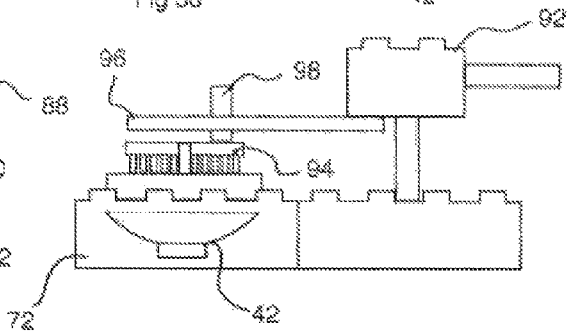
Figure 3E:
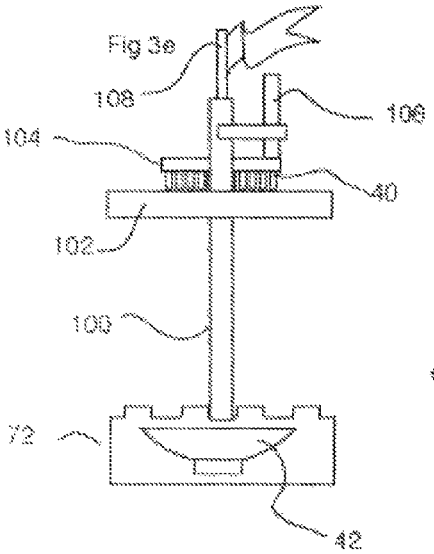
Figure 3F:
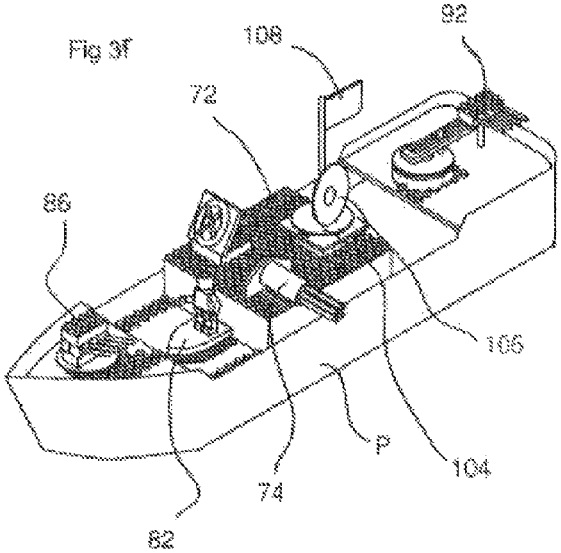

In FIG. 2 we see a cross-sectional view of a toy helicopter 60. Rotary disk 62 has vibration reaction members 40 attached and in contact with vibration source 42. Vibration reaction members 40 are excited by vibration source 42. Attached to rotary disk 62 is transfer shaft 64. Attached to transfer shaft 64 is propeller 66. Propeller 66 rotates to simulate operation of a helicopter. Also in FIG. 2 we see internal reinforcement rib 68. The vibration source 42 imposes harmonic vibration in toy helicopter 60. These harmonic vibrations are transferred to the anterior portion of the toy helicopter 60 through reinforcement rib 68. Attached to the anterior portion of the toy helicopter 60 is a tail propeller 70. Tail propeller 70 is biased to one position with one blade of the tail propeller 70 slightly heavier than the other blades. The harmonic vibrations imposed by the vibration source 42 are such that the tail propeller 70 rotates reacting to the harmonically imposed vertical alternating driving force. Although not illustrated the vibration source is controlled by a signal generator that imposes differing frequencies and amplitude that can be altered to impose different harmonics to increase or decrease or reverse the direction of the tail propeller 70.

In FIG. 3(*a*) we see a cross sectional view of a building block that has a vibration source 42 firmly attached to the building block 72. Attached to building block 72 can be a multiplicity of differing sonically operated devices. FIG. 3(*a*) depicts a toy gatling gun 74 attachment that simulates for the child the action of a gatling gun. The gatling gun rotates about the shaft 76 that extends through support 78. The vibrations from vibration source 42 are transferred through building block 72 and into vibration reaction members 40. Vibration reaction members 40 are biased to impose horizontal rotation of the toy gatling gun 74 to rotate about shaft 76 to simulate repeated firing of the gatling gun 74.

In FIG. 3(*b*) we see construction figure 80 that is attached to oriented sled base 82 that rests on the building block 72. The vibrations from vibration source 42 are transferred through building block 72. The oriented sled base 82 moves construction figure 80 in a direction dictated by the bias of reaction members 40.

In FIG. 3(*c*) we see a toy gun turret 86 that has connected to its base vibration reaction members 40. The toy gun turret 86 includes a barrel 88. Actuation of the vibration source 42 acting through the vibration reaction members act to rotate the gun turret about the excited vertical pivot rod 90.

In FIG. 3(*d*) we see a swinging gun turret 92 that is swung from side to side by crank plate 94 that moves crank link 96 through pin 98.

FIG. 3(*e*) shows an elevated observation platform 102 mounted to upright vibration transfer column 100 that is attached by friction to building block 72. It should be noted that the vibration source that provides differing frequencies and amplitude is controlled by a signal generator and that the vibrations are transferred to observation platform 102 through transfer column 100. The vibration reaction members 40 rests on observation platform 102. Vibration reaction members 40 are attached to drive disk 104 with drive disk 104 rotating in a horizontal plane in reaction to the vibrations of observation platform 102. Signal disk 106 rests on the upper surface of drive disk 104. As drive disk 104 rotates signal disk 106 is driven by friction in the opposite rotational direction.

It should be noted that transfer column 100 has a hollow upper portion to allow a play flag 108 to be inserted. Play flag 108 loosely maintains position, however some movement is present from the vibrations transferred through vibration transfer column 100.

FIG. 3(*f*) displays a three quarter perspective view of a building block play set P. Assembled to building block play set P is vibration building block 72. Vibration building block 72 imposes vibration in the building block play set. Here we see a gaffing gun 74, oriented sled base 82, gun turret 86, swinging gun turret 92, drive disk 104, signal disk 106 and play flag 108. It should be further noted that drive disk 104 can be made of variable thicknesses and materials to react to a limited range of frequency and other drive disks can have a construction to operate on alternate frequencies and amplitude to delight the child by the start and stop nature of such play. Although building block play set is configured in the shape of a ship the construction of a block play set P can be any number of different configurations limited only by the child's imagination.

Figure 4A:
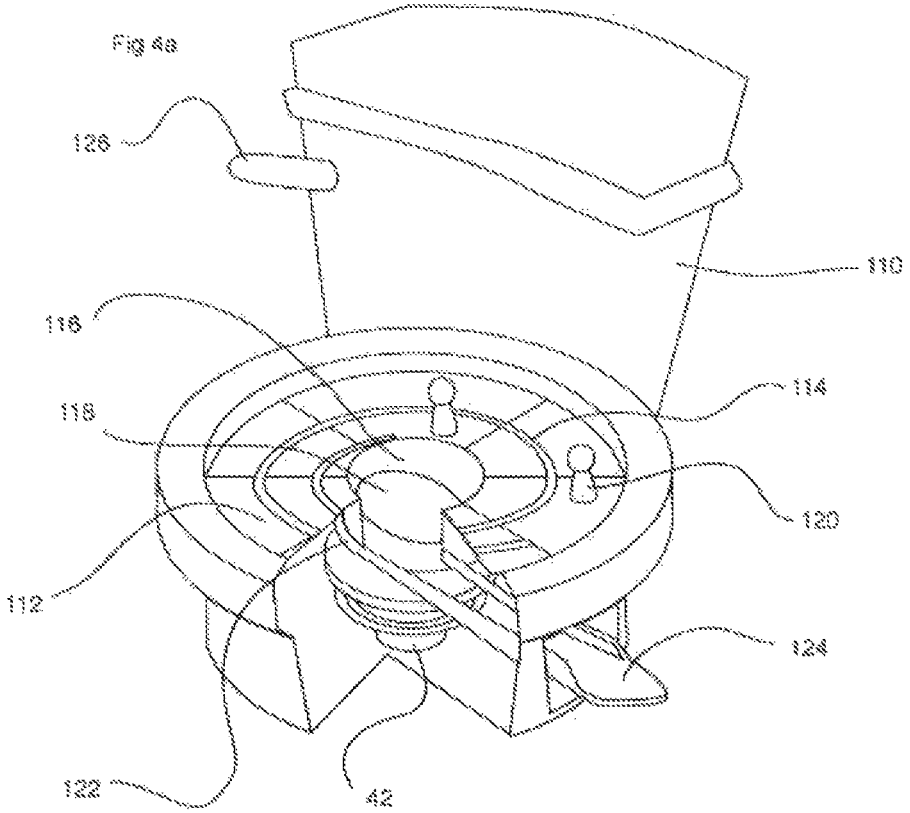
FIG. 4(*a*) is a perspective cutaway view of a sonically operated plumbing game.
Figure 4B:
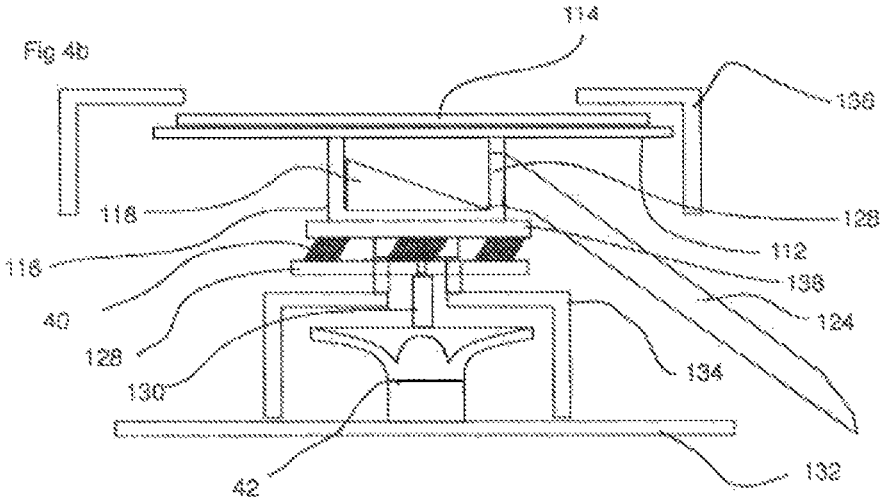

In FIG. 4(*a*) we see a perspective cutaway view of a sonically operated plumbing game 110. Plumbing game 110 has a rotating play surface 112 and stationary guide spiral 114. Centrally located in the upper bowl area of plumbing game 110 is a drain 116. Located in drain 116 is a diverter ramp 118. Game play pieces 120 are placed on rotating play surface 112 by each player. When child operates momentary switch 126 play surface 112 rotates from vibrations from vibration source 42 the game play pieces 120 are moved until they contact stationary guide spiral 114. Guide spiral 114 moves the game play pieces inwardly towards drain 116. When a game play piece falls into drain 116 ramp 118 guides game play piece 120 to a position where game play piece 120 can slide down discharge chute 124 when discharge aperture 128 (FIG. 4*b*) is in alignment with discharge chute 124. It should be noted that game play pieces are inhibited by wall 122 until aperture 128 is in alignment with discharge chute 124. It should be further noted that vibration source 42 is controlled by a signal generator shown in previous drawings that supplies inputs that impart differing frequencies and amplitude to be expressed by the vibration source 42.

In FIG. 4(*b*) we see a cross sectional view of plumbing game 110. Here we see rotating play surface 112 and a stationary guide spiral 114. Centrally located in the upper bowl area of plumbing game 110 is drain 116. Located in drain 116 is diverter ramp 118. Rotating play surface 112 is attached to drive plate 138 which has vibration reaction members 40 affixed thereto. Attached to vibration source 42 is transfer pin 130 that transfers the vibration to plate 128. Transfer pin 130 passes through bearing support 134 that is attached to base plate 132. Bearing support 134 allows for contact with play surface 112 without impeding the vibration of plate 138. Rim 136 provides place for graphics as well as protection for rotating play surface 112. It should be noted that vibration source 42 can produce sound as well as pure vibration to enhance game play.

Figure 5:
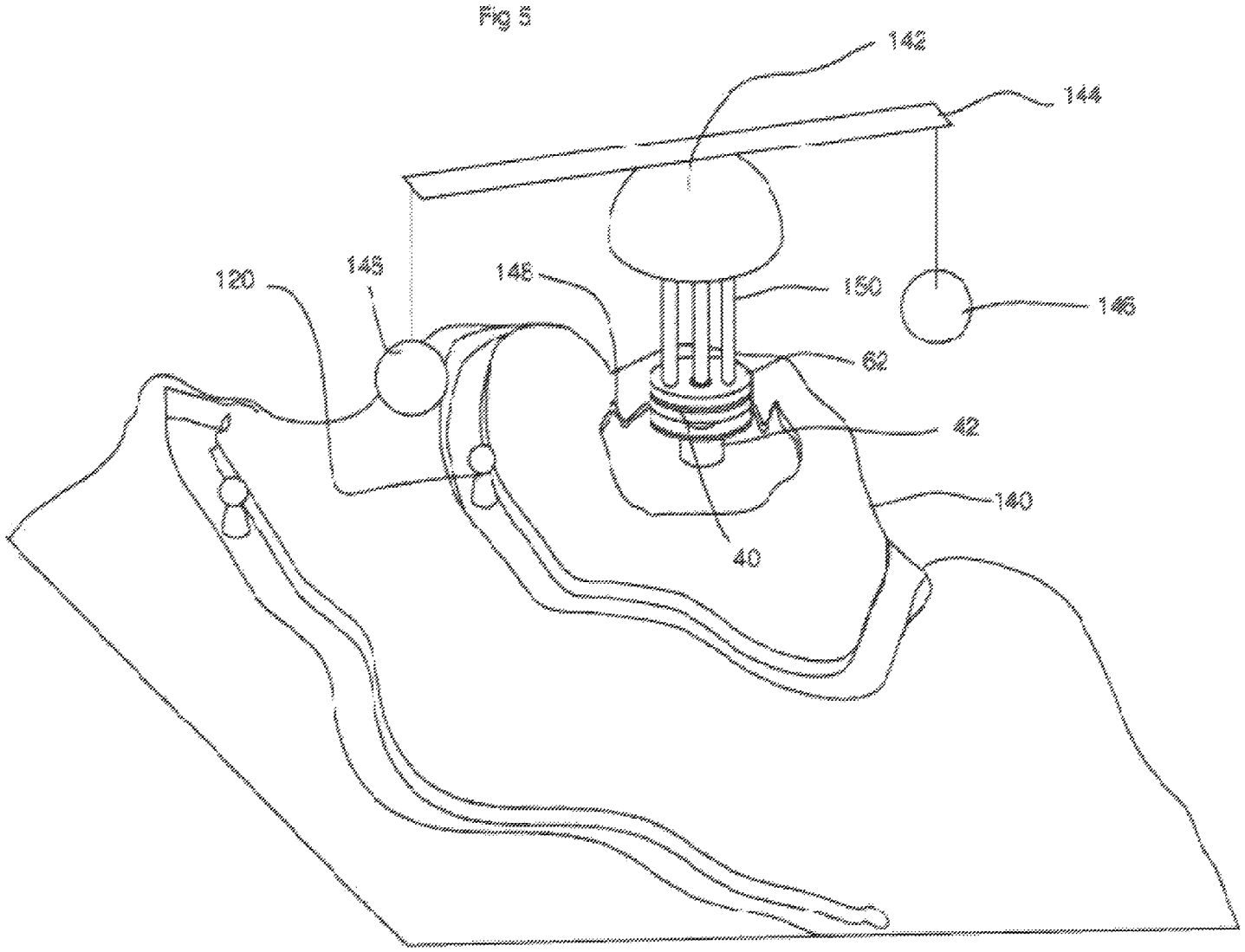
FIG. 5 is a molded play surface game having swing weights operated by a sonic motion mechanism that engages play pieces located on the game surface.

In FIG. 5 we see a molded play surface game 140 with vibration source 42 located under and attached to surface 148. Located on the outer surface is gauntlet mechanism 142 that is comprised of vibration reaction members 40; rotary disk 62 and upright support members 150. Attached to the upper portion of upright support members 150 is cross beam 144. Affixed to each end of cross beam 144 is a swing weight 146. It should be noted that vibration source 42 is controlled by a signal generator shown in previous drawings that supplies inputs that impart differing frequencies and amplitude to be expressed by the vibration source 42. Gauntlet mechanism 142 rotates in reaction to vibrations generated by vibration source 42. If a game play piece 120 is in the path of either swing weight 146 when gauntlet mechanism 142 is rotating, game play piece 120 will be knocked off the game play surface 148 and the player will have to move to the designated space. It should be noted that vibration source 42 can produce sound as well as pure vibration to enhance game play.

Figure 6:
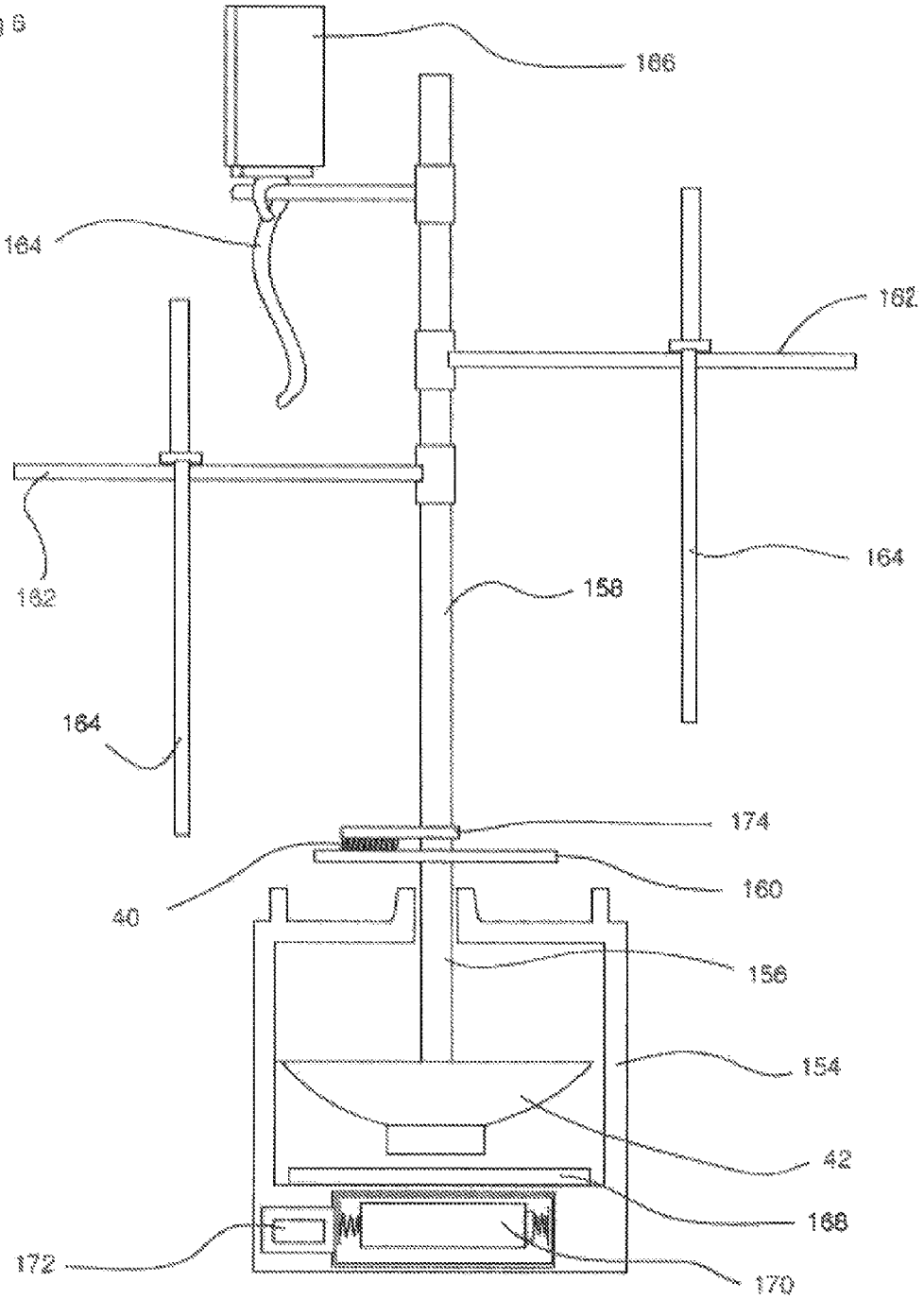
FIG. 6 is a cross sectional view of an upright game apparatus including vertically mounted game play structure excited by a sonic motion apparatus, which game play rods include game play figures mounted thereon that move outwardly in response to the vibrations of the game play rods.

In FIG. 6 we see a cross sectional view of an upright game apparatus 154. Vibration source 42 is energized by signal generator 168 that is provided current from batteries 170 through switch 172. Attached to vibration source 42 is game upright 158. Game upright shaft 156 has game play rods 162 protruding axially to support game play figure 164. It should be noted that game play rods 162 are angled slightly to allow game play figures 164 to travel outwardly when excited by vibration source 42 through game upright 156. Game play figures 164 will fall off play rods 162 when they move beyond the end of game play rods 162. It should be noted that game play figures have a label surface 166 which allows upright game apparatus 154 to be themed in various ways. Also attached to game upright 158 is vibration disk 160. Resting on vibration disk 160 is pointer 174. On the contact side of pointer 174 is vibration reaction members 40. Vibration source 42 can produce sound as well as pure vibration to enhance game play.

Figure 7A:
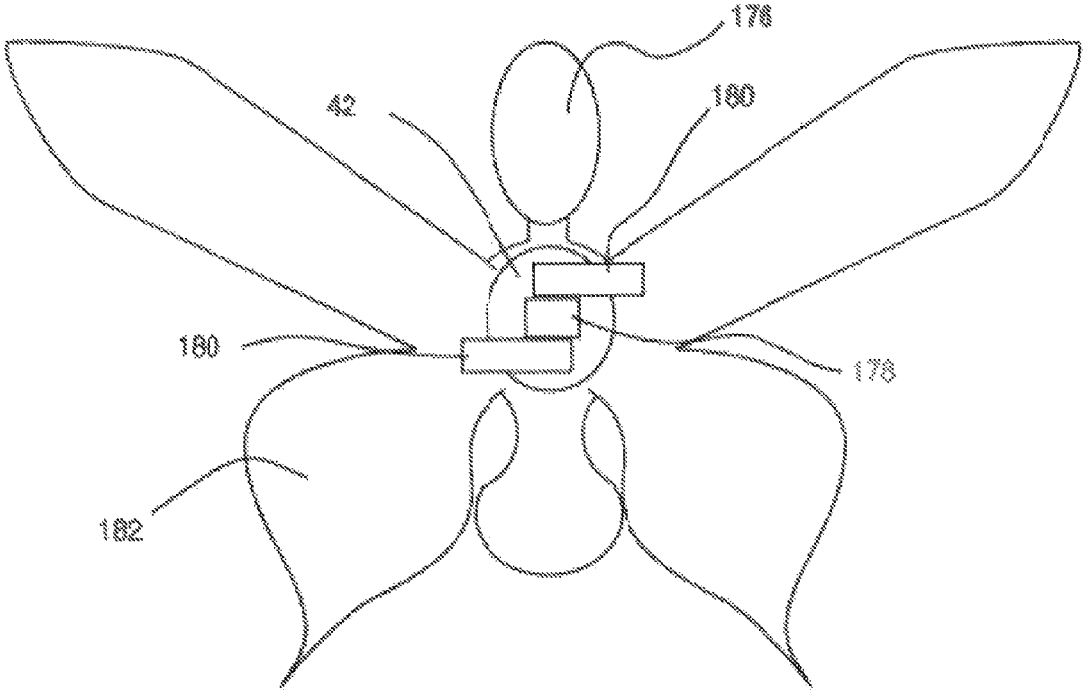
FIG. 7(*a*) is a cross sectional view of a winged toy character in which the wings are flapped by a sonically controlled mechanism.
Figure 7B:
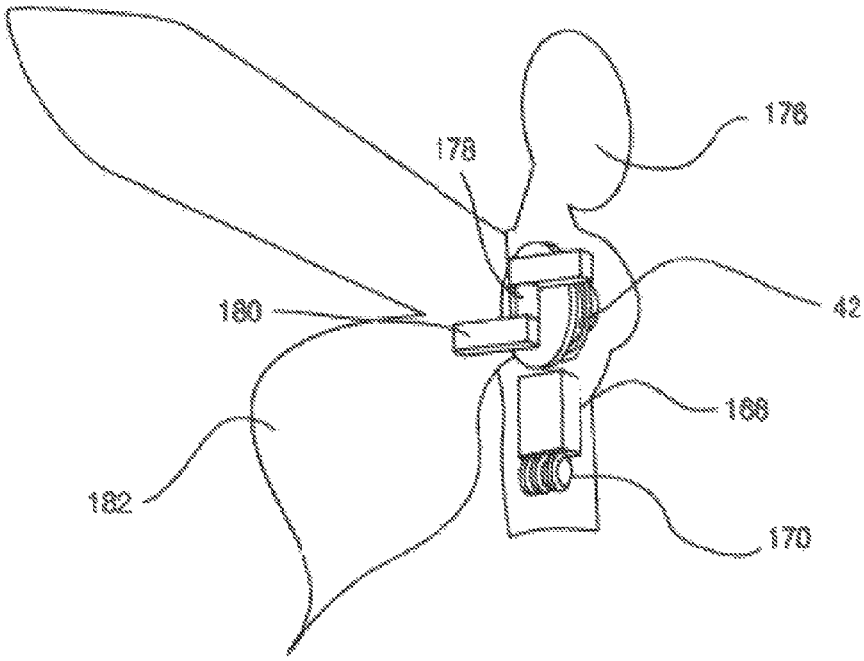

In FIG. 7(*a*) we see a cross sectional view of a winged toy character 176. Located in winged toy character 176 is vibration source 42. Connected to vibration source 42 is link 178. Connected to link 176 are wing levers 180. Attached to wing levers 180 are thin wings 182.

In FIG. 7(*b*) we see a perspective side view of winged toy character 176. In winged character 176 we see vibration source 42, signal generator 168 and batteries 170. As vibration source 42 receives a signal from signal generator 168, link 178 moves in and out. Because link 178 is connected to wing levers 180 and to the thin wings 182, a simulation of wing flapping is obtained It should be noted that vibration source 42 can produce sound as well as pure vibration to enhance play.

Figure 8:
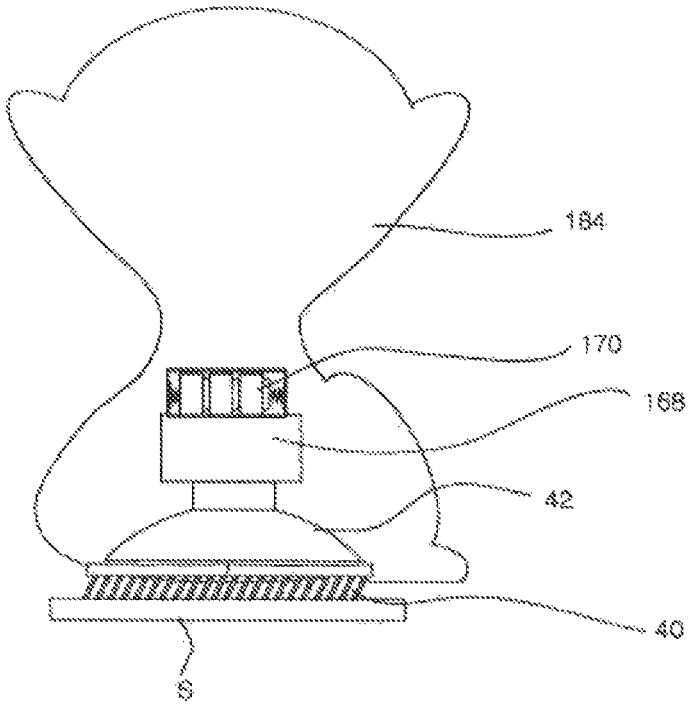
FIG. 8 is a cross sectional view of a free character moved by a sonic controlled device.

FIG. 8 illustrates a cross sectional view of a free character 184. Contained in free character 184 are vibration source 42, signal generator 168 and batteries 170. Directionally connected to vibration source 42 are vibration reaction members 40. Free character 184 is placed on a surface S with vibration reaction members 40 in direct contact with surface S. As vibration source 42 receives a signal from microprocessor 168, vibration reaction members 40 interact with surface S and moves the free character 184.

Figure 9:
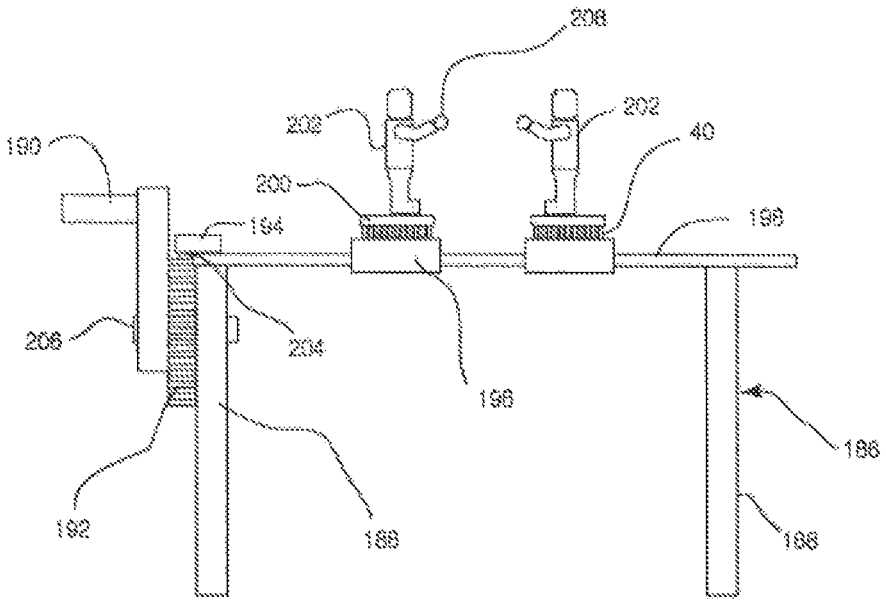
FIG. 9 is a side view of a character battle arena in which the characters are mounted on sonically activated disks and moved toward each other into engagement.

In FIG. 9 we see a side view of a character battle arena 186. Battle arena 186 is elevated by surface clearance legs 188 on each end of battle arena 186. Attached to surface clearance legs 188 is crank axle 206 Rotating around crank axle 206 is hand crank 190. Attached to hand crank 190 is exciter gear 192. Exciter gear 192 contacts reed 204 to impact vibration into battle bar 198. On battle bar 198 is character sled 196 that has vibration reaction members 40 in contact with battle bar 198 (not shown). Each of the characters is a similar construction. When hand crank 190 is rotated the characters 202 move from the outer limits of the battle bar 198 and meet in close proximity to the middle. Each character is mounted to rotary disk 200 that has vibration reaction members 40 that contact the upper surface of character play sled 196. The discs are connected to the play sleds but are free to rotate relative thereto. The imparted vibrations transferred through character sled 196 cause the vibration reaction members 40 and rotary disk 200 to spin the character 202. Essentially, there are vibration members (not shown) that function to move the sled forward linearly relating to the battle bar and transfer the vibration up to the vibration member 40 to rotate the disks to spin its respective character. A toy weapon placed in the character hand 208 will dislodge the opposing character from the battle bar 198 and the remaining character 202 will be declared winner of the battle. Although shown here as a single hand crank 190 a second hand crank 190 could be used on the other end of battle arena 186. In this configuration the battle bar 198 would be a construction that each hand crank 190 would excite only one portion of the battle bar 198. Typically these sections would be parallel to each other and extend the entire length of the battle bar 198. In this arrangement the vibration reaction members 40 for each character sled 196 would only contact one portion of the parallel battle bar 198. Although not shown character battle arena 186 could have an electronically controlled vibration source 42. It should be noted that vibration source 42 can produce sound as well as pure vibration to enhance play.

Figure 10:
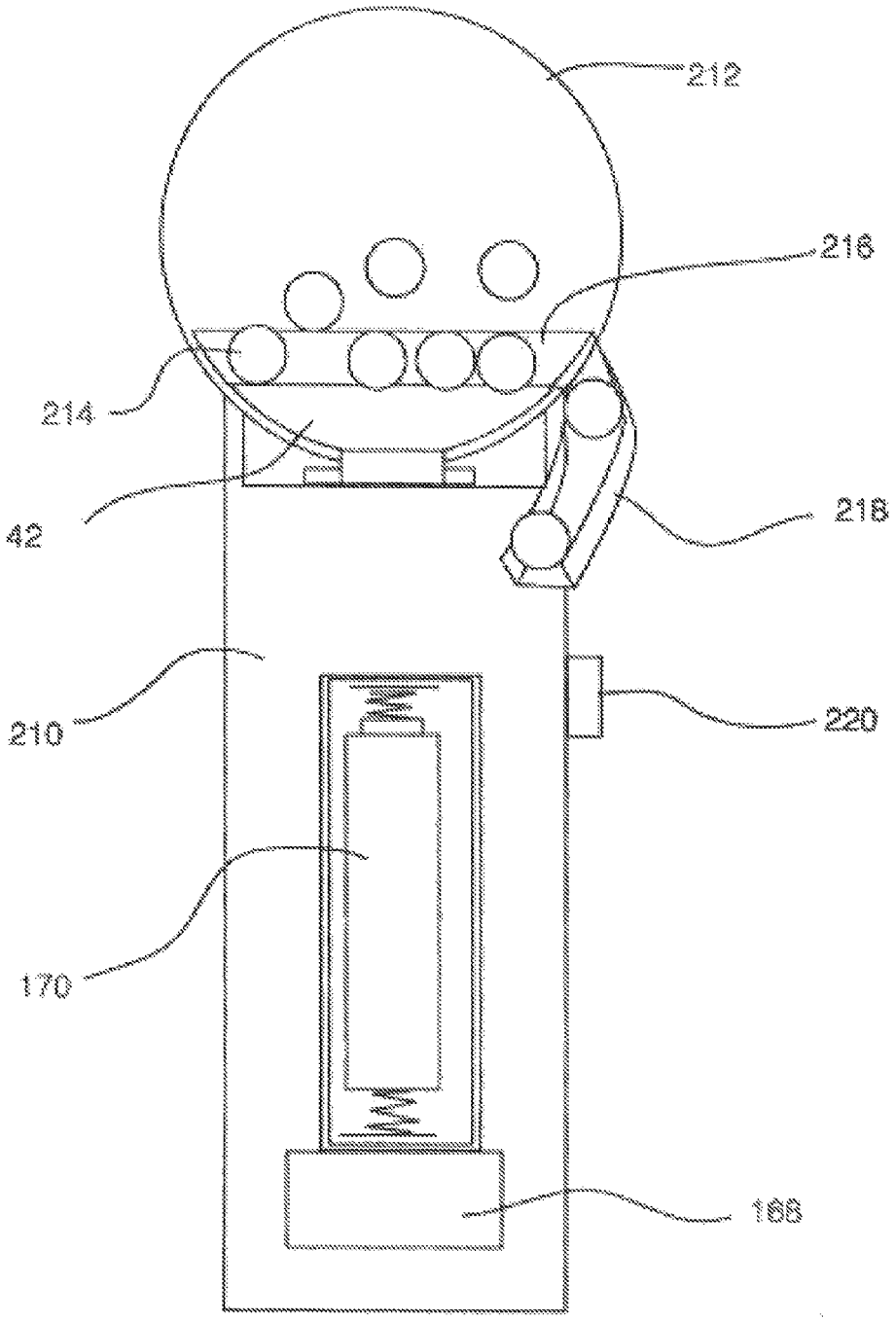
FIG. 10 illustrates a snack food or cereal dispenser.

In FIG. 10 we see a side view of sonically operated snack food or cereal dispenser 210. Cereal dispenser 210 has a storage receptacle 212 that holds food puffs 214. Food puffs 214 are excited by contact with the surface of vibration source 42. Food puffs 214 are moved along food guide 216 to food chute 218. Vibration source 42 is controlled by a signal generator 168 that supplies inputs that impart differing frequencies to be expressed by the vibration source 42. Microprocessor 168 is activated by momentary switch 220 that allows currents from batteries 170. Vibration source 42 can produce sound as well as pure vibration to enhance play as well as impact nutritional information.

Figure 11:
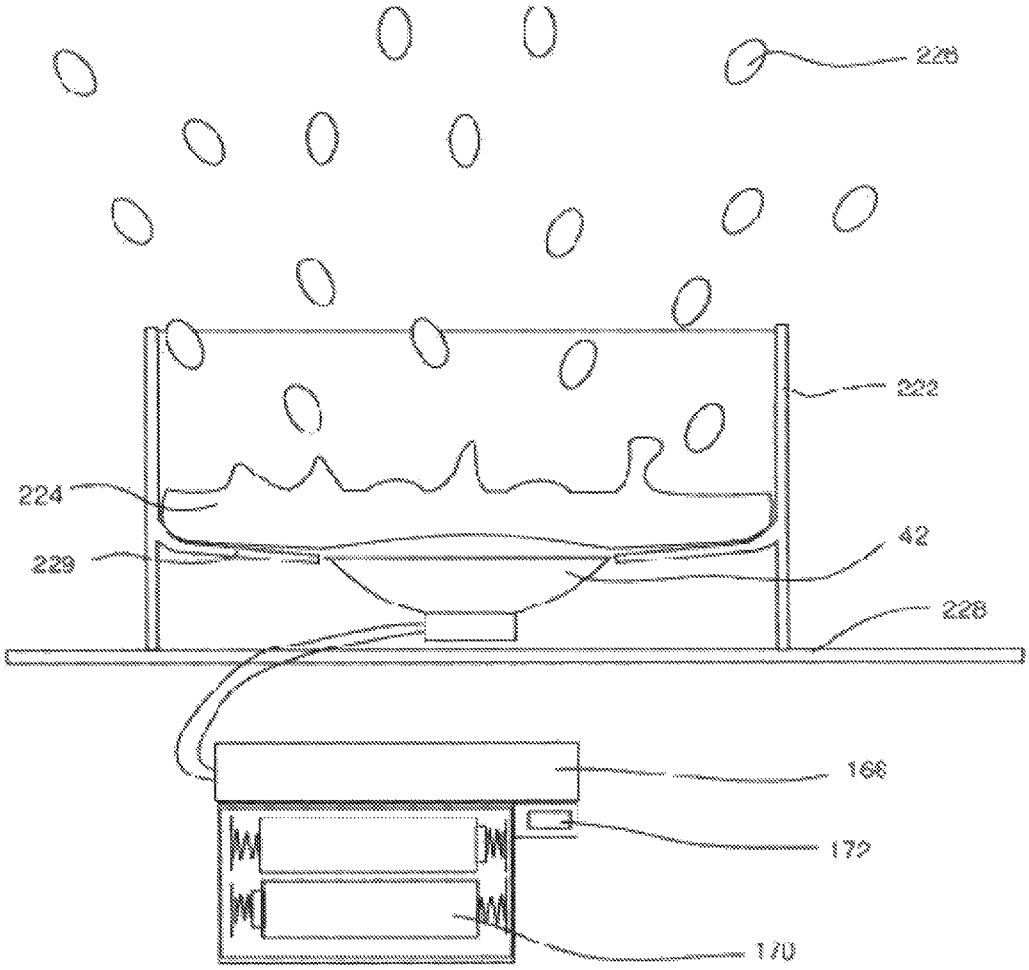
FIG. 11 is a paint activity set.

FIG. 11 discloses a sonically operated paint activity set 222. Located in the base of paint activity set 222 is a vibration source 42 that is connected to membrane 229. Paint 224 rests on membrane 229. Vibration source 42 is controllable by a signal generator 168 that supplies inputs that impart differing frequencies and amplitude to be expressed by the vibration source 42. Signal generator 168 is activated by switch 172 that allows current from batteries 170. When vibration source 42 is activated paint 224 is broken down into droplets 226 and expressed into the air above activity set 222. Some droplets 226 fall outside activity set 222 and create interesting patterns on paper 228 placed under activity set 222. Differing frequencies and amplitude produce different patterns on paper 228.

Figure 12A:
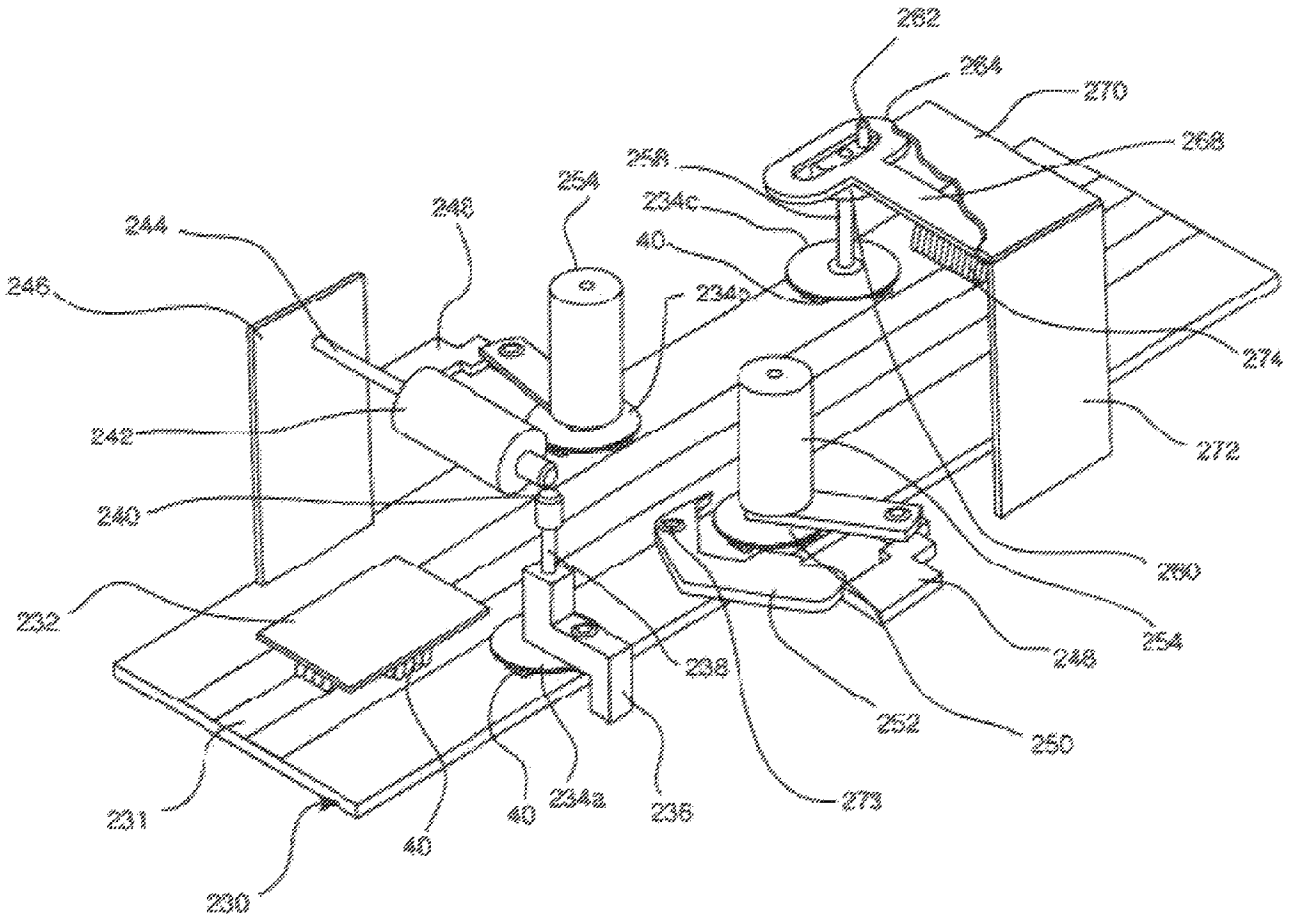
FIG. 12*a* displays a three quarter perspective view of a car wash play set.
Figure 12B:
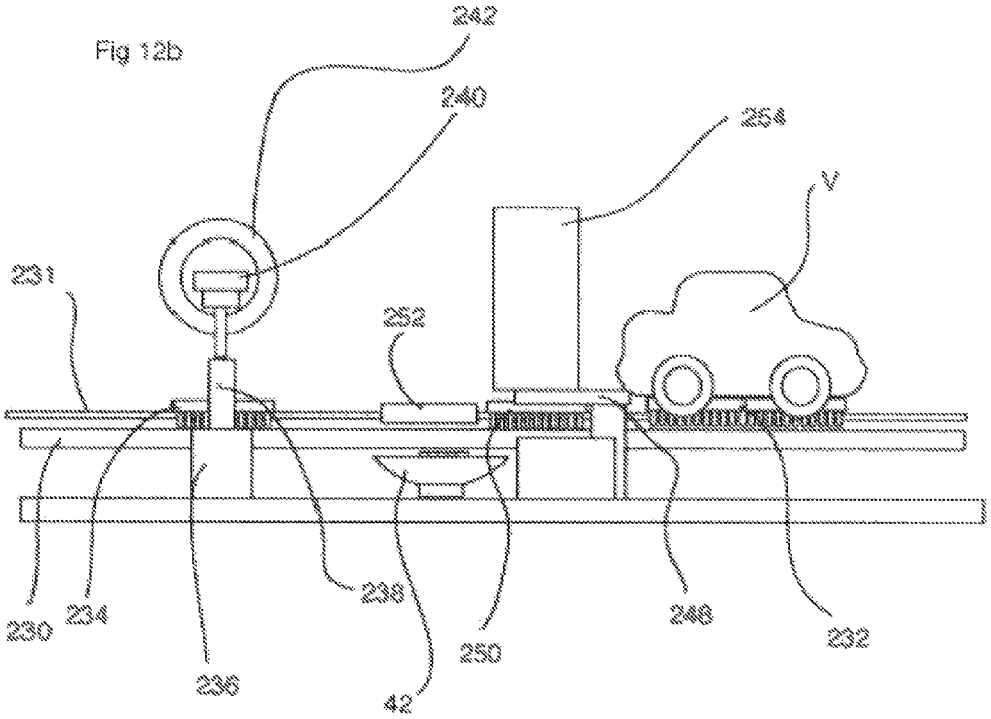
FIG. 12*b* is a side view of the car wash play set of FIG. 12*a;*

FIG. 12*a* displays a three-quarter perspective view of a car wash play set 230. In the car wash play set 230 is a vibration base 231 which is excited by vibration source 42 (FIG. 12*b*). On vibration base 231 rests oriented vehicle sled 232. On lower portion of oriented vehicle sled 232 are vibration reaction members 40. Vehicle V (FIG. 12*b*) is placed on oriented vehicle sled 232 and moves along vibration base 231 in reaction to inputs from vibration sources 42 (FIG. 12*b*). Also in contact with vibration base 231 are rotary drive disks 234*a*, 234*b* and 234*c* which have vibration reaction members 40 on the lower portion oriented to impose a rotating motion. Attached to rotary drive disk 234*a* is vertical shaft 238. Attached to the upper portion of vertical shaft 238 is a bevel gear 240 which drives horizontal brush 242. Horizontal brush 242 rotates around horizontal shaft 244 which is supported by upright 246. Also in contact with vibration base 231 is interrupted rotary drive disk 250. Interrupted rotary drive disk 250 rotation is controlled by stop 252. Attached to interrupted rotary disk 250 is vertical brush 254. Interrupted rotary disk 250 and vertical brush 254 are supported by bearing block 248. Although shown here with one stop 252 engaged with forward interrupted rotary disk 250 a second or more stops 252 could be utilized. We also see rotary drive disk 234*c* Which has attached shaft 258 and a crank 260. The crank 260 has a pin 262 that extends through a slot in follower 264. A crank member 268 is connected to follower 264. The pin 262 works in conjunction with follower 264 to change the rotary motion of rotary drive disk 234*c* into a reciprocating action to operate brush 274 connected to the end of crank member 268. Brush 274 is guided by plate 270 which is supported by brush upright 272.

In FIG. 12*b* we seen a side view of car wash play set 230. Here we see the vibration source 42 is connected to the lower portion of vibration base 231. In addition, we see vehicle V loosely positioned on oriented vehicle sled 232.

Figure 12C:
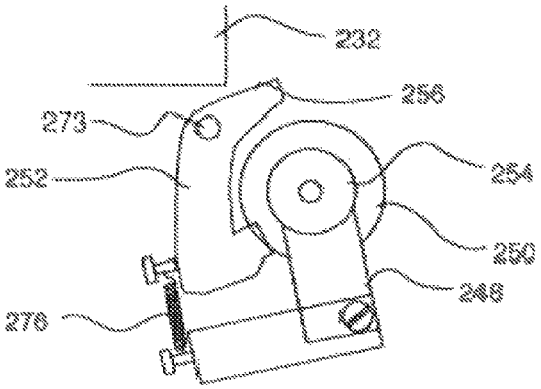
FIG. 12*c* is a partial plan view of the car wash assembly illustrating a locking mechanism for a rotating brush when out of engagement with a vehicle sled.

In FIG. 12*c* we see lock 252 in a position where the rotation of interrupted rotary disk 250 is inhibited by stop 252. Stop 252 has attached spring 276 and is under spring tension inhibiting the rotation of interrupted rotary disk 250. It should be noted that stop 252 has pivot 273. Oriented vehicle sled 232 is in a position just prior to addressing stop 252.

Figure 12D:
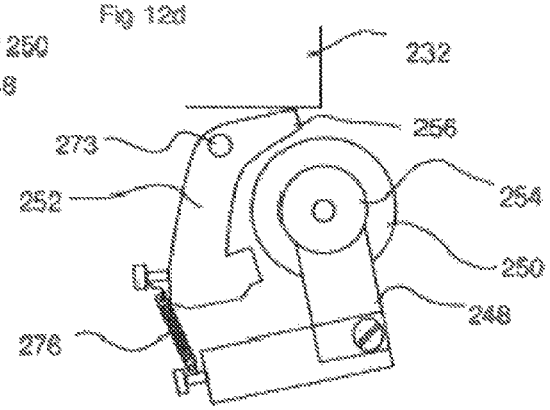
FIG. 12*d* is a view similar to FIG. 12*c* with the rotating brush shown in the unlocked position.

In FIG. 12*d* we see that oriented vehicle sled has moved forward to address stop 252 at contact point 256. Stop 252 has rotated around pivot 273 and interrupted rotary disk 250 can move freely in a rotary motion. It should be noted that once oriented vehicle sled has moved to a position where the side of oriented vehicle sled 232 is no longer in contact with stop 252 at contact point 256, spring 276 rotates stop 252 around pivot 273 back to a position illustrated in FIG. 12*c*.

It is intended to cover by the appended claims all embodiments that fall within the true spirit and scope of the invention.

The invention claimed is:

1. A sonically operated play set including:

a building block having a vibration surface, a vibration source configured to vibrate the vibration surface, at least one mechanism rotatably coupled to the vibration surface via a shaft, the at least one mechanism having a plurality of vibration reaction members in contact with the vibration surface configured to rotate the associated mechanisms relative to the vibration surface as determined by the orientation of the vibration members, wherein one of the at least one mechanisms is a model gatling gun having a plurality of horizontally disposed rotatably mounted barrels, wherein the shaft is oriented horizontally, and wherein the vibration reaction members are affixed to a base in engagement with the vibration surface, and the vibration reaction members are biased to rotate the gun barrels relative to its base about the horizontally oriented shaft in response to activation of the vibration source.

2. The play set of claim 1, wherein one of the at least one mechanisms is a figurine on a rotary base.

3. The play set of claim 1, wherein one of the at least one mechanisms is a rotating gun turret located on the vibration surface having a base containing rotationally oriented vibration reaction members in contact with the vibration source, a pivot pin supporting the gun turret relative to the vibration source, wherein the vibration reaction members are oriented to rotate the gun turret relative to the vibration surface in response to activation of the vibration source.

4. The play set of claim 3, wherein a crank mechanism is disposed between the gun turret and the rotationally oriented vibration reaction members whereby activation of the vibration source causes the rotating gun turret to be swung from side to side by the crank mechanism.

5. The play set of claim 1, further comprising:

a transfer column having a hollow upper portion to allow a play flag to be inserted located on the vibration surface in communication with said vibration source and extending through a platform, and a base having rotationally oriented vibration members disposed about the transfer column and in contact with the platform whereby activation of the vibration source will rotate the column.

6. An action figure comprising:

a movable lower jaw, a vibration source assembly for moving the moveable lower jaw, a power operated microprocessor, an oriented vibration reaction member connected to the vibration source assembly, wherein:

the oriented vibration reaction member is i) excited by the vibration source assembly and ii) configured to drive a cam mechanism interposed between the moveable lower jaw and the oriented vibration reaction member;

the cam mechanism is configured to open and close the moveable lower jaw; and the power operated microprocessor is configured to: control operation of the vibration source, move the jaw in response to the microprocessor through the action of said vibration source assembly, and vary one or both of a frequency and amplitude associated with the vibration source to vary the speed of the movable lower jaw.

7. A sonically operated toy assembly comprising:

one or more play pieces, a vibration source having a vibrating surface, power for operating said vibrating surface, a power operated programmer for controlling the frequency and amplitude of the vibrating surface, a plate containing rotationally oriented fibers responsive to said vibrating surface to provide rotation for said plate, said plate being part of a game apparatus whereby the programmer will provide the requisite game action, wherein:

the plate is part of a molded play surface, located on the play surface or play pieces, attached to the plate are upright support members, attached to an upper portion of the upright support member, a cross beam having a swing upright attached to its ends, when the vibration source is activated, the upright support members are rotated to move the cross beam and associated weights to engage the play pieces and knock them off the play surface.

8. A play in the form of a car wash, the play set comprising:

a vibration surface having a vibration source configured to vibrate the vibration surface;

a plurality of mechanisms on the vibration surface, the plurality of mechanisms having directionally oriented vibration members in contact with the vibration surface, wherein activation of the vibration source causes the plurality of mechanisms to move relative to the vibration surface as determined by the orientation of the vibration members;

one of the plurality of mechanisms comprising a vehicle sled for carrying a car through the play set having downwardly disposed and directionally oriented fibers in contact with said vibration surface to move a car through said car wash set; and brushes operated by another of the plurality of mechanisms and disposed adjacent to the car on the vehicle sled.

9. The play set of claim 8, wherein some of the plurality of the mechanisms include disks from which the vibration members extend and include vertically disposed shafts to which the brushes are attached.

10. The play set of claim 9, further comprising:

a disk with downwardly directed vibration members, a vertically disposed shaft driven by the disk, a horizontally disposed crank and gearing connecting the vertically disposed shaft and the horizontally disposed brush configured to rotate the brush in response to the movement of the vertically disposed shaft.

11. The play set of claim 10, further comprising:

a disk with downwardly directed vibration members, a vertically disposed shaft driven by the disk, a transversely disposed brush, and a crank mechanism operated by the vertical shaft to move the transversely disposed brush horizontally in response to the rotation of the vertical shaft.

12. The play set of claim 8, further comprising locking means for halting the rotation of the vertically mounted brushes when the vehicle sled is not in contact therewith.

13. The play set of claim 12, wherein the locking mechanism is in position to be engaged by the vehicle sled when the vehicle sled comes into engagement with the locking mechanism to permit the brushes to be rotated to simulate a washing action.

* * * * *